US005979815A

United States Patent [19]

Svanstroem et al.

[11] Patent Number: 5,979,815

[45] Date of Patent: Nov. 9, 1999

[54] YARN-FEEDING DEVICE

[75] Inventors: Anders Svanstroem, Ulricehamn; Paer Josefsson, Boras, both of Sweden

[73] Assignee: Iro AB, Ulricehamn, Sweden

[21] Appl. No.: 09/029,799

[22] PCT Filed: Sep. 4, 1996

[86] PCT No.: PCT/EP96/03881

§ 371 Date: May 18, 1998

§ 102(e) Date: May 18, 1998

[87] PCT Pub. No.: WO97/09263

PCT Pub. Date: Mar. 13, 1997

[30] Foreign Application Priority Data

Sep. 8, 1995 [DE] Germany ..... 195 33 312

[51] Int. Cl.[6] ..... B65H 51/00; D03D 47/36

[52] U.S. Cl. ..... 242/365.3; 139/452; 242/365.4

[58] Field of Search ..... 242/365.3, 365.4, 242/365.5; 139/452

[56] References Cited

U.S. PATENT DOCUMENTS

| | | | |
|---|---|---|---|
| 4,645,134 | 2/1987 | Sarfati | 242/365.5 |
| 4,710,947 | 12/1987 | Klein . | |
| 5,094,275 | 3/1992 | Shaw et al. | 242/365.4 X |
| 5,310,127 | 5/1994 | Deiuri | 242/365.4 |
| 5,520,226 | 5/1996 | Pedrini | 139/452 |
| 5,560,556 | 10/1996 | Claesson et al. | 139/452 X |
| 5,671,783 | 9/1997 | Zenoni et al. | 139/452 |

FOREIGN PATENT DOCUMENTS

| | | |
|---|---|---|
| 0 049 896 A1 | 4/1982 | European Pat. Off. . |
| 0 170 798 A2 | 2/1986 | European Pat. Off. . |
| 0 501 024 A1 | 9/1992 | European Pat. Off. . |
| 0 567 045 A1 | 10/1993 | European Pat. Off. . |
| 0 635 592 A1 | 1/1995 | European Pat. Off. . |

*Primary Examiner*—Michael R. Mansen

*Attorney, Agent, or Firm*—Flynn, Thiel, Boutell & Tanis, P.C.

[57] ABSTRACT

In a yarn feeding device having a winding element which is rotatingly drivable relative to a stationary housing and which has an outer, ring-like edge that overlaps an interior housing flange in an axially open gap portion, a catching element for catching dirt adhering to the inner surface of the edge is provided within an overlap at at least one point of the outer circumference of the housing flange, the catching element either projecting into the gap portion or receding from the gap portion.

20 Claims, 3 Drawing Sheets

YARN-FEEDING DEVICE

FIELD OF THE INVENTION

The present invention relates to a yarn feeding device having a stationary housing and a rotatable winding element.

BACKGROUND OF THE RELATED ART

In yarn feeding devices (with or without weft measuring device; with or without integrated brake ring; with rotatable winding element and stationary storage drum or with a rotatable storage drum as the winding element; for weaving machines or for knitting machines), there is a standardized construction used in the axial transition area from the housing to the winding element, as shown in EP 0 567 045 A1, FIG. 5 for a yarn feeding device with rotatable winding element and stationary storage drum. This means that an overlap with an open gap portion is provided between the annular edge of the winding element and the housing flange. The outer circumferential surface of the housing flange is smooth, as is the inner circumferential surface of the edge. Since the winding element rotates at a variable speed relative to the stationary housing flange, and since some clearance must be maintained between the ring and the housing flange because of manufacturing tolerances, the following phenomenon can be observed during operation of such a yarn feeding device: The processed yarn material constantly produces dirt, such as lint, dust, small fiber pieces, and the like, which tends to enter, inter alia, into the gap portion and to get stuck there and to travel gradually from the gap portion into the interior of the yarn feeding device, which may lead to operational malfunctions. Dirt gets, in particular, stuck to the inside of the ring, leading to the formation of a coherent dirt layer.

Attempts have already been made to integrate a fan into the yarn feeding device, wherein the fan comprises fan blades which rotate with the winding element, and produces a flow during operation in order to blow away dirt. As a result, however, dirt is increasingly sucked from the surroundings into the interior of the yarn feeding device.

It is known from U.S. Pat. No. 4,710,947 that the gap portion is designed in the manner of a labyrinth seal to make access more difficult for dirt. Nevertheless, deposits are formed that can grow inwards into the yarn feeding device.

It is the object of the present invention to improve a yarn feeding device of the above-mentioned type in a constructionally simple and inexpensive manner such that malfunctions caused by deposited dirt are largely avoided.

SUMMARY OF THE INVENTION

This object is achieved according to the invention wherein a catching element is provided in a gap defined between the housing and the winding element for removing dirt therefrom.

With such a configuration, the catching element fulfills two functions. First of all, the formation of a thick dirt layer on the inside of the ring is counteracted because during relative movement the catching element forms a periodic irregularity as a disturbing factor during the accumulation of a dirt layer, with such a factor counteracting the deposition of dirt from the very beginning. Furthermore, surprisingly enough, the catching element mechanically acts on dirt on the inner surface of the ring. On account of the different centrifugal forces acting on the dirt, the latter will expand inwards at a standstill of the ring or at a low speed until it collides with the catching element and is entrained at least at some places. The entrained dirt will choose the path which offers the least resistance and will be catapulted out of the opening of the gap portion. An entrained dirt piece might first hang onto the catching element and then sweep along the inside of the ring. In addition, the air entrained during rotation.

In the embodiment wherein the catching element defines a radial entraining surface, the entraining surface represents a mechanical obstacle as well as a flow obstacle for dirt. When the entraining surface has an undercut, lint clusters will very easily get hooked, whereby deposited dirt is entrained from the inside of the ring and the inside is swept over before the dirt is ejected from the gap portion.

In the embodiment wherein a deflection surface is oriented oblique to the circumferential rotation direction, an advance force is exerted on entrained or just arriving dirt, thereby conveying the dirt from the gap portion to the outside. The deflection surface conveys the dirt in the manner of a plow, also supported by turbulences and air cushions.

It is particularly expedient to combine the entraining surface and the deflection surface in order to entrain dirt and to convey it away from the gap portion.

It is advantageous to provide at least one entraining surface and, optionally, a deflection surface for each rotational direction of the ring, so that the self-cleaning effect takes place during operation of the yarn feeding device independently of the respectively chosen rotational direction of the edge entry.

In this context, providing a relaxation zone in front of the catching element is also of importance, because dirt which has already deposited will expand inwards into the relaxation zone when the centrifugal force is decreasing, and will be entrained upon acceleration of the ring.

The embodiment wherein the catching element is a projection is simple from a constructional point of view. The catching element may already have been molded onto the housing flange during the production of the latter. However, it is also possible to mount the catching element at a later time, for instance, to secure it with an adhesive, by screwing or in another manner.

An alternative embodiment follows wherein the catching element is a recessed defined by radial boundary surfaces. The recess also performs the function of a catching element.

In the embodiment wherein the catching element has a rough surface, an additional disturbing factor in the accumulation of a dirt layer is achieved with the structure provided on the surface of the projection.

The embodiment having a recess is simple and efficient from a constructional point of view. The recess simultaneously creates the entraining surface and the deflection surface, respectively, for each rotational direction, while the bottom of the recess creates the necessary relaxation zone.

A particularly good effect will be achieved with a sharp-edged shape of the projection or recess.

With the embodiment wherein the projection has a height of about 1 to 3 mm, excellent results can be achieved with almost all yarn qualities.

A similarly advantageous effect is achieved by a recess having a length of about 4 to 10 mm, preferably 7 to 8 mm, and a depth of about 2 to 6 mm, preferably 4 to 5 mm.

A particularly advantageous embodiment follows wherein the housing flange includes protection means. The edge bead of the protection means, which protects against unintendedly formed windings behind the disk, is used for an additional task, as the edge bead together with the recess has the task to loosen and discharge dirt. By contrast, the protection means has the function to prevent yarn from penetrating into the interior of the yarn feeding device in cases where the yarn has passed behind the ring and has been wound there.

Finally, it is expedient to distribute a plurality of catching elements over the circumference so that an irregular arrangement, in particular, enhances the disturbing effect. The catching elements also may have a regular circumferential spacing.

BRIEF DESCRIPTION OF THE DRAWINGS

Embodiments of the subject matter of the invention shall now be explained with reference to the drawing, in which.

DETAILED DESCRIPTION

Figure 1:
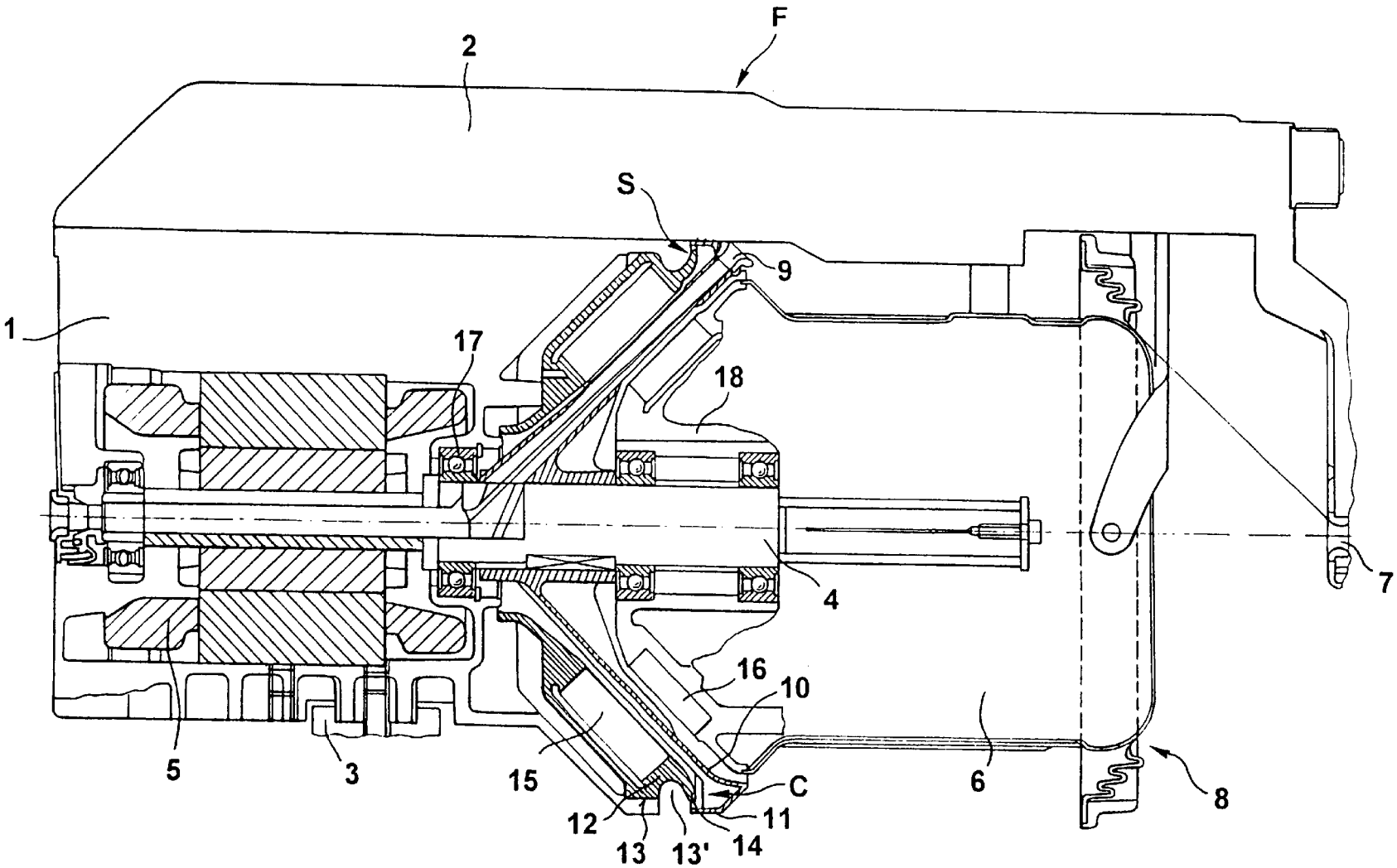
FIG. 1 diagrammatically shows a longitudinal section through a first embodiment of a yarn feeding device.

A yarn feeding device F according to FIG. 1 (longitudinal section with hatching only for those components that are of importance to the invention) comprises a stationary housing 1 which has secured thereto a longitudinally extending extension arm 2. Housing 1 is fixed with the aid of a mount 3. Housing 1 has rotatably supported therein a drive shaft 4, for instance, with roller bearings 17 which are rotatingly drivable by means of an electric motor 5. A storage drum 6 is rotatably supported on shaft 4 by means of bearings 18 and is prevented from rotating together with shaft 4 (stationary storage drum) by means of cooperating permanent magnets 15 and 16 arranged in housing 1 and in storage drum 6. A yarn eyelet 7 for the yarn which is withdrawn overhead the storage drum 6 is provided on extension arm 2 approximately in an extension of the axis of storage drum 6. An annular yarn withdrawal brake 8, which is supported in extension arm 2, optionally cooperates with storage drum 6.

Drive shaft 4 has mounted thereon a winding element 9 (winding tube) by which the yarn passing through the hollow shaft 4 in the rear portion thereof is guided onto storage drum 6 in windings. The winding element 9 can be integrated into a conical disk 10 having an approximately cylindrical edge 11. Housing 1 is provided with a stationary housing flange 12 which grips with an operlap Ü below edge 11 and defines, together with said edge 11, a gap portion S which is axially open to the left side. In FIG. 1, a protection means 13' against unintendedly formed windings behind the disk is molded in housing flange 12 into an approximately cylindrical circumferential surface 13 and terminates in an edge bead 14 which grips below ring 11. In the area of the edge bead 14 and the outer circumference 13 of the housing flange 12, respectively, there is provided at least one catching element C which will be explained in detail with reference to FIGS. 5 and 6.

Figure 2:
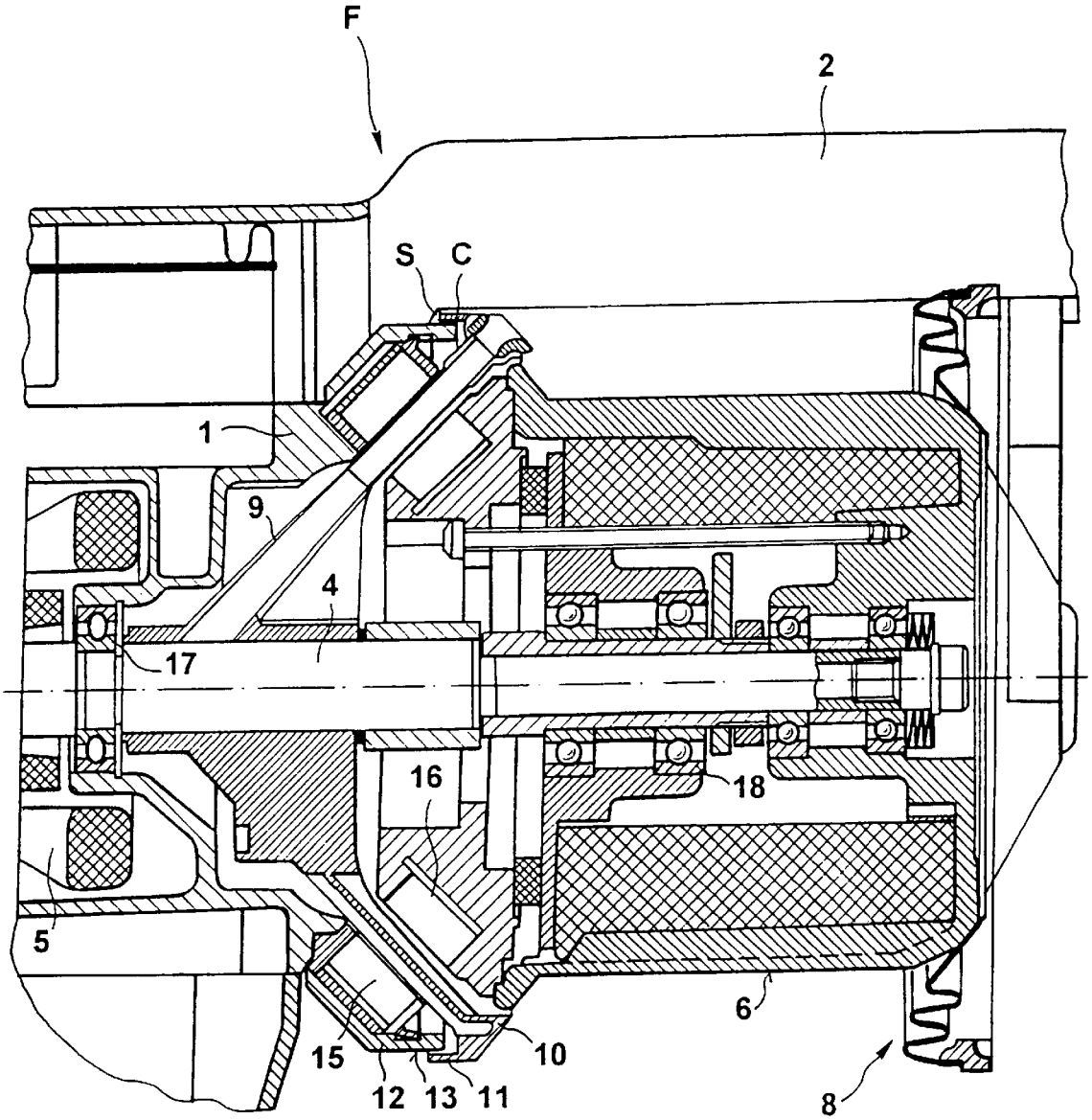
FIG. 2 shows part of a longitudinal section of a further embodiment of a yarn feeding device.

In the embodiment of the yarn feeding device F according to FIG. 2, there are similar components as in the yarn feeding device shown in FIG. 1. The shaft 4 which is rotatingly driven by the electric motor 5 carries the winding element 9 and the storage drum 6, which is prevented from rotating therewith, by means of the permanent magnets 15, 16. An annular yarn brake optionally cooperates with storage body 6. The outer circumference 13 of the housing flange 12 has an approximately cylindrical shape and grips from the inside under the edge 11 of the disk 10 of the winding element 9. Shaft 4 is supported with roller bearings 17 in housing 1 whilst the storage body 6 is supported with roller bearings 18 on shaft 4.

Figure 3:
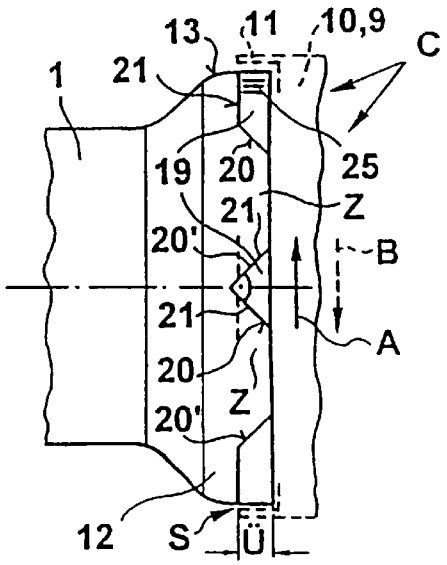
FIG. 3 shows part of the housing of the yarn feeding device of FIG. 2 with differently formed catching elements.
Figure 4:
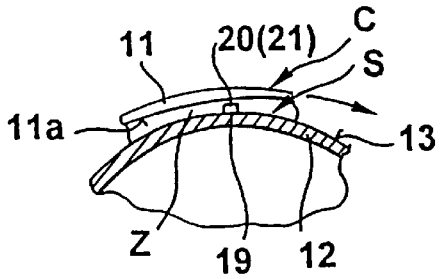
FIG. 4 shows part of a cross section of a further embodiment.

At least one catching element C, which shall be explained in more detail with reference to FIGS. 3 and 4, is provided in the gap portion S which is defined between the edge 11 and the circumferential surface 13 of the housing flange 12.

Instead of the yarn brake 8, a yarn measuring device could cooperate with storage drum 6. Furthermore, the storage drum 6 could be rotatably drivable and then define the winding element 9, with edge 11 and housing flange 12 cooperating in the same manner as shown in FIGS. 1, 2.

When yarn material is processed on yarn feeding devices, dirt, such as small fiber pieces, dust and above all lint, which has the objectionable property to adhere to metallic or plastic components or is carried along by air currents to any place and then deposits there, is formed in considerable amounts. Dirt which possibly passes into the interior, e.g. to the roller bearings 17, and which may seriously disturb the operation of the yarn feeding device also deposits on the inside of edge 11. The gap portion S is required for manufacturing reasons (e.g. because of manufacturing tolerances). Since the winding element 9 is sometimes stopped, accelerated or declerated, or runs at a high speed, air flows from the outside to the inside or from the inside to the outside through the gap portion S cannot be avoided. The at least one catching element C is provided for avoiding great amounts of deposits in the gap portion S and in the interior of the yarn feeding device and for entraining dirt and for discharging the same to the outside.

According to FIG. 3, the housing flange 12 of housing 1 is provided on its approximately cylindrical outer circumference 13 with at least one catching element C in the form of a projection 19 which is expediently made integral with housing flange 12 and has a height ranging from 1 mm to 5 mm. In the area of the overlap Ü, projection 19 is located between edge 11, which is shown in broken line and has the shape of a ring, and the housing flange 12. In the rotational direction, the projection 19 which is shown in the center of FIG. 3 has front and rear deflection surfaces 20, 20' which are each combined with an entraining surface 21. At least the entraining surface 21 extends approximately in radial direction relative to the axis of housing 1. It may even be undercut, if necessary. The deflection surfaces 20, 20' are intended for both of the possible rotational directions A and B of the ring so as to exert a respective discharging force, in FIG. 3 to the left side, on dirt which has detached from the inner side of ring 11 and to discharge said dirt from the gap portion S. There may be provided a plurality of such triangular projections 19 along the circumference of the housing flange 12. If ring 11 is only driven in the same rotational direction A or B all the time, one entraining surface 21 will be enough, or a deflection surface 20 or 20' which is combined with an entraining surface 21 and is opposite to the rotational direction A or B.

In FIG. 3, at the top and at the bottom, a catching element of a projection 19 is outlined in an alternative or additive manner, the projection 19 having a greater length in the circumferential direction and carrying a deflection surface 20 and 20', respectively, which is combined with an approximately radial entraining surface 21. As outlined at 25, the outer circumference of the projection 19 could have a structure, for instance, it might be provided with transverse ribs or with saw teeth. The tip of the middle projection which is directed to the left side, as well as the left-hand circumferential edge 21 of the two other projections end approximately with the contour of the ring 11 or project to the left side beyond said ring 11.

FIG. 4 shows a simplified embodiment in which the catching element C is just designed as a simple axial rib or a pin-like projection 19 which defines entraining surfaces 21 and deflection surfaces 20, respectively, at both sides. A relaxation zone Z in which the gap width is greater than the gap width directly above the catching element C is provided in FIGS. 3 and 4 in the rotational direction, each time in front of the catching element C. The upper side of the catching element C is located opposite to the inside 11*a* of edge 11 at a small distance.

When the edge 11 rotates in the indicated rotational direction in FIG. 4, dirt can deposit on the inside 11*a* only with a small thickness because the entraining surface 21 will immediately entrain and displace dirt projecting further to the inside. When dirt nevertheless tends to accumulate on the inside 11*a* in the case of a rapidly running edge 11, then, as soon as the edge 11 is stopped or its rotational movement slowed down, the elastic dirt will expand into the relaxation zone Z before it is subsequently entrained by the rising entraining surface 21. A lint cluster which gets hooked to the entraining surface 21 will sweep along the inside 11*a* until all dirt is entrained and ejected from the gap portion S to the outside. When the entraining surface 21 is combined with a deflection surface 20, the discharge of dirt is even promoted, as outlined in FIG. 3.

Figure 5:
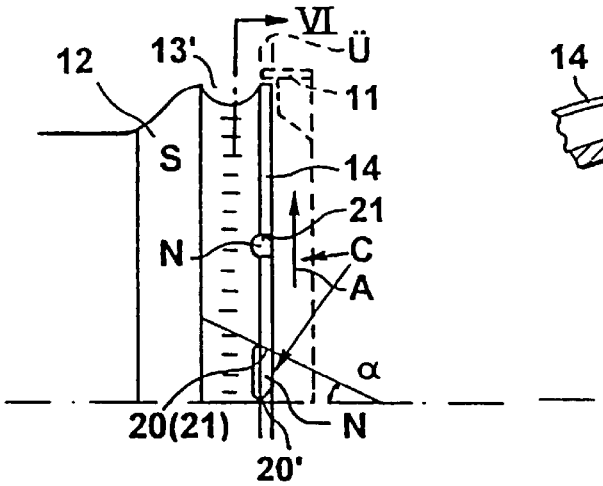
FIG. 5 is a view similar to that of FIG. 3 with respect to the housing flange of the yarn feeding device according to FIG. 1.
Figure 6:
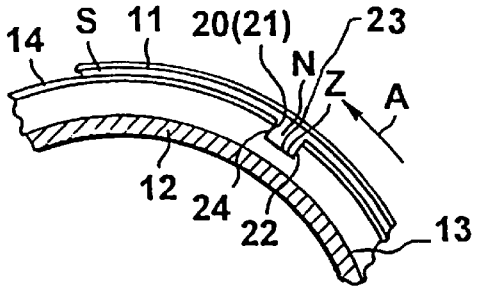
FIG. 6 is a section taken in plane VI of FIG. 5.

In the embodiments shown in FIGS. 5 and 6 (corresponding to the yarn feeding device illustrated in FIG. 1), the catching element C is molded into an edge bead 14 of a protection means 13' against unintendedly formed windings behind the disk, namely in the form of a recess N which, for instance, defines the entraining surface 21 for the rotational direction A of the ring 11 with its approximately radially upright boundary surface. In the recess N which is shown further below in FIG. 5, the boundary surfaces are inclined (angle $\alpha$), so that the boundary surface intended for the rotational direction A defines both an entraining surface 21 and a deflection surface 20 for dirt which is discharged outwards.

Protection means 13' serves to receive and collect yarn windings which due to miswinding on the storage drum have arrived at said means and are not to enter into gap portion S.

As can be seen in FIG. 6, the boundary surfaces 22, 24 of recess N can each define an entraining surface 20 and a deflection surface 21, namely expediently with a very sharp edge, for instance, for the rotational direction A, with the bottom 23 of recess N forming the relaxation zone Z. Recess N in the edge bead 14 has an approximately triangular shape. Its length in circumferential direction is between 7 mm and 8 mm; its depth may be about 4 mm to 5 mm. The boundary surfaces 24 and 22 may also be provided with an undercut to form hooks. An inclined position of the boundary surfaces as shown in FIG. 5, bottom, is also possible.

A plurality of projections 10 and recesses N are expediently distributed in the circumferential direction of the housing flange 12.

In practice, an astonishing cleaning effect against dirt can be observed during use of the above-mentioned catching elements C, and very little dirt accumulates in the interior of the yarn feeding device, for instance, at the roller bearings 17, i.e. also in cases where no deflection surface, but only at least one entraining surface is provided for. This is probably due to the fact that the entrained dirt will follow the line of least resistance, i.e. choose the path through the opening of the gap portion S to the outside and not the more difficult path directed against the centrifugal force, i.e. the path into the interior of the yarn feeding device. Such an astonishing and positive effect can virtually be observed in all yarn qualities to be processed.

We claim:

1. In a yarn feeding device comprising a stationary housing having an interior housing flange, and a winding element which is rotatingly drivable relative to said stationary housing, said winding element having an outer, ring-like edge that overlaps said interior housing flange with an overlap to define an open gap portion therebetween, comprising the improvement wherein a catching element for catching dirt adhering to an inner surface of said edge is provided within the overlap of said edge at at least one point of an outer circumference of said housing flange, said catching element being one of a projection projecting into said gap portion and a recess receding from said gap portion.

2. The yarn feeding device according to claim 1, wherein said catching element has an approximately radial entraining surface which is oriented towards the rotational direction of said edge.

3. The yarn feeding device according to claim 1, wherein said catching element includes at least one entraining surface and at least one deflection surface for each rotational direction of said ring-like edge, said deflection surface extending in a direction oblique to said rotational direction.

4. The yarn feeding device according to claim 3, wherein said entraining surface and said deflection surface are combined.

5. The yarn feeding device according to claim 3, wherein said catching element is said recess which said recess opens outwardly, said entraining surface and said deflection surface being formed by at least one, approximately radial boundary surface of said recess.

6. The yarn feeding device according to claim 5, wherein said recess comprises two, approximately radial, boundary surfaces which rise upwards from a recess bottom, each of said boundary surfaces defining one said catching element for a respective rotational direction of said winding element, and a relaxation zone being formed by said recess bottom between said boundary surfaces.

7. The yarn feeding device according to claim 6, which includes a disk that defines said winding element, said recess being molded into an edge bead of a surrounding protection means of said housing flange for protection against unintendedly formed windings behind the disk, said protection means being provided at the axial opening of said gap portion.

8. The yarn feeding device according to claim 5, which includes a disk that defines said winding element, said projection being molded into an edge bead of a surrounding protection means of said housing flange for protection against unintendedly formed windings behind the disk, said protection means being provided at an axial opening of said gap portion.

9. The yarn feeding device according to claim 5, which includes a disk that defines said winding element, said recess being molded into an edge bead of a surrounding protection means of said housing flange for protection against unintendedly formed windings behind the disk, said protection means being provided at the axial opening of said gap portion.

10. The yarn feeding device according to claim 1, wherein said catching element includes at least one entraining surface and at least one deflection surface for each rotational direction of the ring-like edge.

11. The yarn feeding device according to claim 1, wherein a relaxation zone is provided in a rotational direction of said edge in front of said catching element, a gap width of said gap portion being greater in a circumferential direction of said relaxation zone than above said catching element.

12. The yarn feeding device according to claim 1, wherein said catching element is said projection which is defined integral with said housing flange on the outer circumference thereof, said projection being of a limited extent in a circumferential direction of said housing flange.

13. The yarn feeding device according to claim 12, wherein said projection has a surface structure defined by transverse ribs.

14. The yarn feeding device according to claim 1, wherein said catching element is sharp-edged.

15. The yarn feeding device according to claim 1, wherein a plurality of said catching elements are distributed about said outer circumference of said housing flange, said catching elements being circumferentially spaced apart.

16. In a yarn feeding device comprising a stationary housing having an interior housing flange, and a winding element which is rotatingly drivable relative to said stationary housing in at least one rotational direction, said winding element having an outer, ring-like edge that overlaps said interior housing flange with an overlap to define an open gap portion radially therebetween, comprising the improvement wherein an outer circumference of said housing flange extends in a circumferential direction and includes at least one catching element for catching dirt adhering to an inner surface of said edge, said catching element being disposed below said overlap of said edge and defining an element surface which extends radially away from said outer circumference and faces in said circumferential direction.

17. The yarn feeding device according to claim 16, wherein said catching element is defined by a projection, said element surface projecting radially outwardly away from said circumferential surface into said gap portion.

18. The yarn feeding device according to claim 16, wherein said catching element is defined by a recess, said catching surface extending radially inwardly away from said gap portion.

19. The yarn feeding device according to claim 16, wherein a plurality of said catching elements are provided on said outer circumference in circumferentially spaced relation.

20. The yarn feeding device according to claim 16, wherein opposite sides of said catching element each define one said catching surface, said catching surfaces on said opposite sides facing in opposite circumferential directions to catch dirt when said winding element rotates respectively in opposite rotational directions.

* * * * *